US006764339B2

(12) United States Patent
Kubo

(10) Patent No.: US 6,764,339 B2
(45) Date of Patent: Jul. 20, 2004

(54) SHIELDED CONNECTOR

(75) Inventor: Takafumi Kubo, Tokyo (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/320,923

(22) Filed: Dec. 17, 2002

(65) Prior Publication Data

US 2003/0119346 A1 Jun. 26, 2003

(30) Foreign Application Priority Data

Dec. 20, 2001 (JP) ..... 2001-387465

(51) Int. Cl.[7] ..... H01R 13/648

(52) U.S. Cl. ..... 439/607; 439/609; 439/610; 439/746; 439/748

(58) Field of Search ..... 439/607, 609, 439/610, 746, 748

(56) References Cited

U.S. PATENT DOCUMENTS 5,358,428 A 10/1994 Bixler et al. ..... 439/607
5,660,558 A * 8/1997 Osanai et al. ..... 439/353
5,797,770 A * 8/1998 Davis et al. ..... 439/607
5,865,646 A * 2/1999 Ortega et al. ..... 439/607
6,039,606 A 3/2000 Chiou ..... 439/610
6,120,325 A * 9/2000 Abe ..... 439/607
6,132,253 A * 10/2000 Wu ..... 439/607

FOREIGN PATENT DOCUMENTS

JP 2001-126819 5/2001 ..... H01R/24/08

OTHER PUBLICATIONS

European Search Report dated Mar. 17, 2003, application No. EP 02 25 8712.

* cited by examiner

*Primary Examiner*—Dean A. Reichard
*Assistant Examiner*—Anton B Harris
(74) *Attorney, Agent, or Firm*—Barley Snyder

(57) ABSTRACT

An electrical connector having a shielding shell. The shielding shell disposed about an insulating housing mounted on a circuit board. The shielding shell including a first shell and a second shell. The first shell having a first side wall. The first side wall having a first locking member. The second shell having a second side wall. The second side wall having a second locking member corresponding to the first locking member. When the second locking member engages the first locking member the first side wall overlaps with the second side wall to prevent movement of the second shell in a vertical and horizontal direction in relation to the first shell.

14 Claims, 2 Drawing Sheets

SHIELDED CONNECTOR

BACKGROUND OF THE INVENTION

The present invention relates to an electrical connector and, more particularly, to an to an electrical connector having a shielding shell for blocking external electromagnetic waves.

DESCRIPTION OF THE PRIOR ART

Various types of electrical connectors, such as cellular telephones, are provided with a metallic shielding shell to protect signal paths of the connector from external electromagnetic waves. The connector has an insulating housing having electrical contacts disposed therein. The shielding shell covers an outer periphery of the insulating housing and is generally formed by punching and bending a metal plate into a cubical or cylindrical shape. The shielding shell has a seam at a position where ends of the metal plate abut each other. Because the ends of the metal plate simply abut each other, if an excessive external prying force is applied to the shielding shell when the connector is mated to a mating connector, the ends of the metal plate may spread causing the shielding shell to deform.

In an effort to alleviate this problem, Japanese Unexamined Patent Publication 2001-126819 teaches a shielding shell formed from a metal plate wherein ends of the metal plate overlap and are fastened to each other. One end of the metal plate is folded upward to form an insertion supported portion. Both sides of an other end of the metal plate are cut-out and folded to form fastening portions. The ends are overlapped and fastened by the fastening portions to fix the ends of the metal plate to each other. This shielding shell provides resistance against deformation by prying forces applied in a direction perpendicular to the vertical direction, that is, in the direction perpendicular to a plane of the overlapped ends of the metal plate. However, the shielding shell may still be deformed when a prying force is applied in a direction parallel to the plane of the ends of the overlapped metal plate, because the ends of the shielding shell can still shift along that plane.

It is therefore desirable to develop a shielding shell that will resist deformation due to prying forces and external forces in any direction.

SUMMARY OF THE INVENTION

The invention relates to a shielding shell for an electrical connector. The shielding shell includes a first shell and a second shell. The first shell has a first shell end. The first shell end having a first locking member. The second shell having a second shell end. The second shell end having a second locking member corresponding to the first locking member. When the second locking member engages the first locking member the first shell end overlaps with the second shell end to prevent movement of the second shell end in a vertical and horizontal direction in relation to the first shell end.

DETAILED DESCRIPTION OF THE PREFERRED EMBODIMENT

Figure 1:
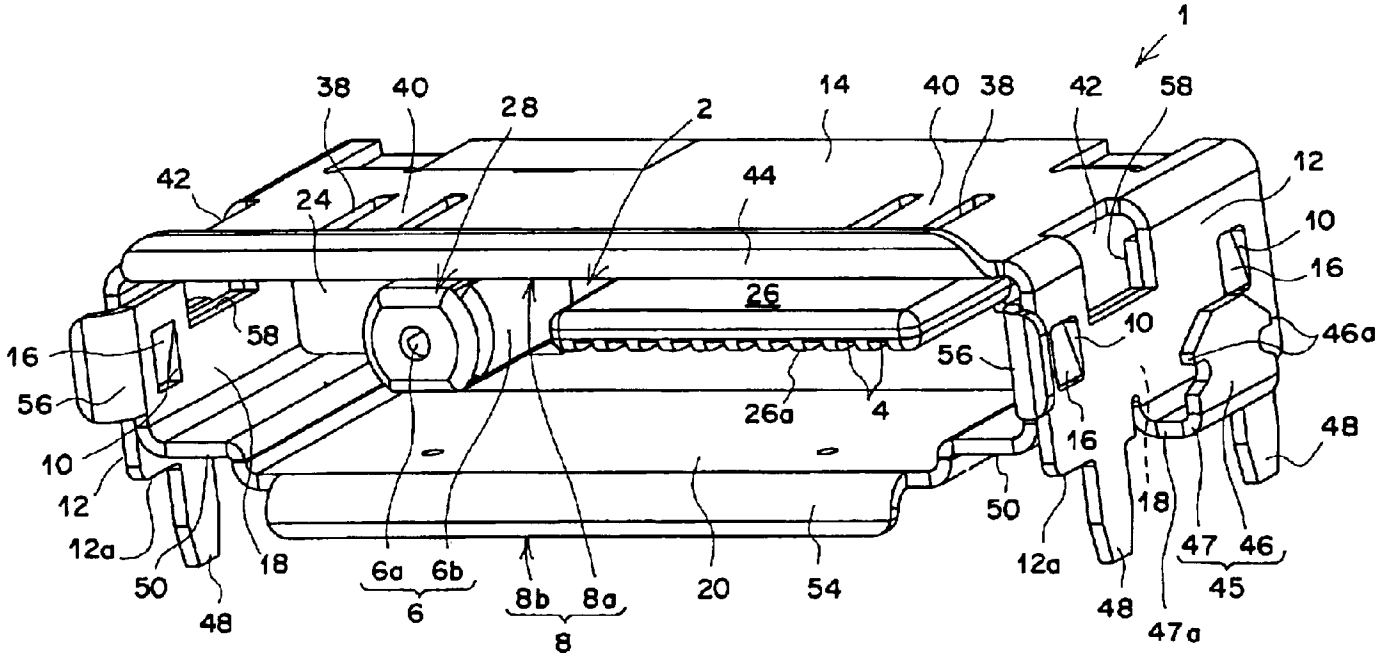
FIG. 1 is a perspective view from a side of an engagement opening of an electrical connector having a shielding shell according to the present invention.
Figure 2:
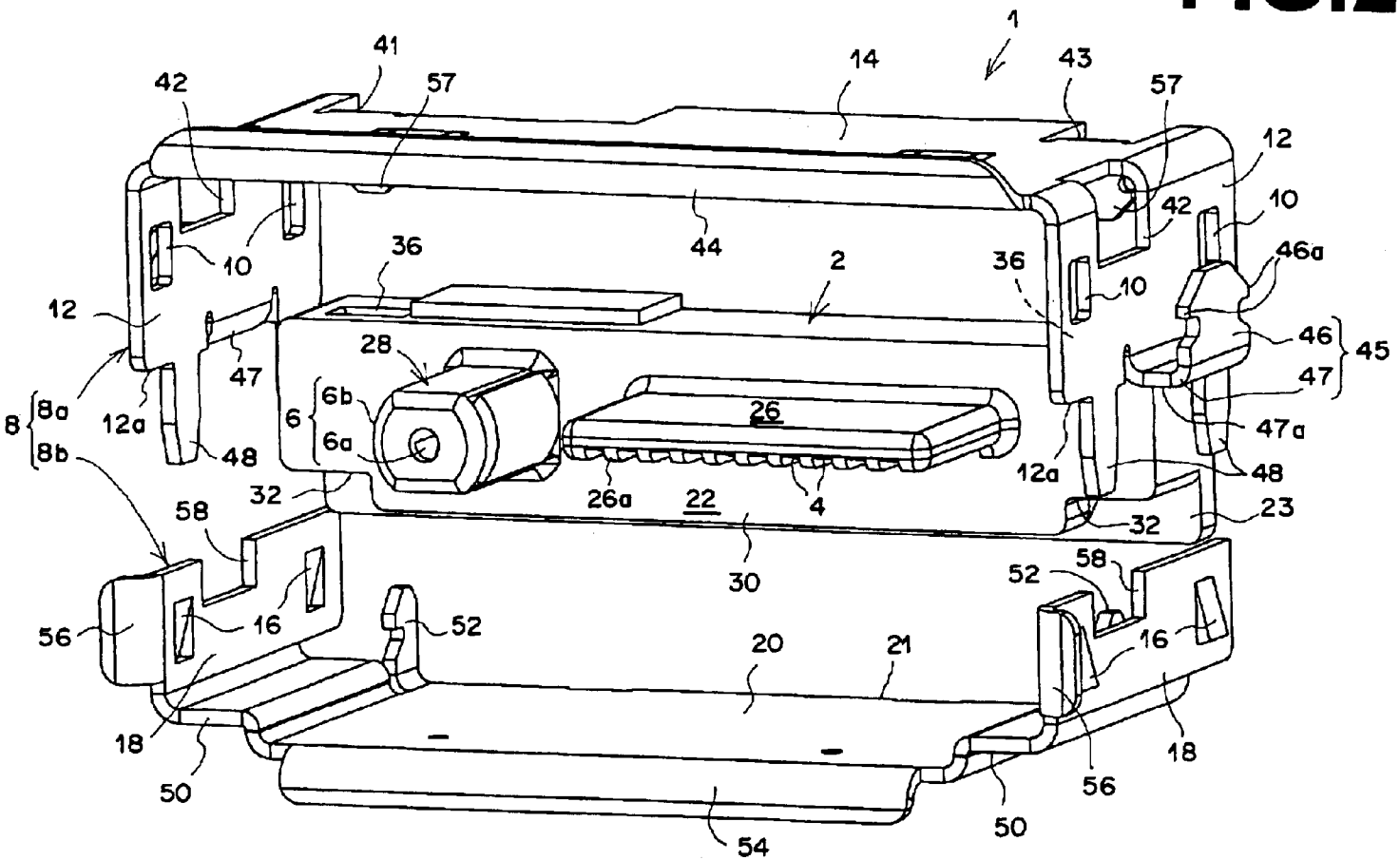
FIG. 2 is an exploded perspective view of the electrical connector of FIG. 1.

FIGS. 1–2 show an electrical connector 1 having an insulating housing 2 covered by a shielding shell 8. As shown most clearly in FIG. 2, the housing 2 has a horizontal engagement rib 26 and a cylindrical protrusion 28. A plurality of contacts 4 are arranged on the engagement rib 26 and are separated from each other by a plurality of walls 26*a*. The cylindrical protrusion 28 houses a coaxial contact 6. The coaxial contact 6 has a central contact 6*a* and an arcuate outer contact 6*b*. Steps 32 are formed on both sides of a bottom 30 of the housing 2. A plate 23 that abuts a rear edge 21 of a lower shell 8*b* is formed on the bottom 30 of the housing 2 and extends in a lengthwise direction thereof (the horizontal direction in FIG. 2). Holes 36 are formed at both sides of an upper portion of the housing 2.

The shielding shell 8 has an upper shell 8*a* and the lower shell 8*b*. The upper shell 8*a* has an upper wall 14 and downwardly extending side walls 12 at both edges thereof. As shown most clearly in FIG. 2, cutouts 41, 43, are formed at both sides of a rear edge of the upper wall 14. The cutouts 41, 43 have downwardly extending engagement pieces 57. The engagement pieces 57 are press-fit into the holes 36 of the housing 2 when the housing 2 and the upper shell 8*a* are assembled to fix the housing 2 and the upper shell 8*a* to each other. A pair of engagement apertures or first locking members 10 is formed on each of the side walls 12 of the upper shell 8*a*. The engagement apertures 10 are separated from each other and are positioned along an insertion/removal direction of the connector 1.

A top guide piece 44 is formed at a forward edge of the upper wall 14 and extends from one side wall 12 to the other side wall 12. The top guide piece 44 guides a mating connector (not shown) into engagement opening 24. As shown in FIGS. 1 and 2, rectangular openings 42 are formed in the upper wall 14 and the side walls 12, 12. The rectangular openings 42 engage locking arms (not shown) of the mating connector (not shown). The locking arms (not shown) of the mating connector (not shown) engage with the openings 42 to lock the connectors to each other.

As shown most clearly in FIG. 1, tongue pieces 40 formed from U-shaped slits 38 are positioned in the vicinity of both edges of the upper wall 14. The tongue pieces 40 extend forward (the direction toward the engagement opening 24 or the foreground in FIGS. 1 and 2) and downward. The tongue pieces 40 act as contact pieces for electrical grounding and contact a shielding shell (not shown) of the mating connector (not shown) that is received in the engagement opening 24. Although the tongue pieces 40 are described as extending forward in this embodiment, the tongue pieces may alternatively be formed to extend backward.

Each of the side walls 12 has an engagement protrusion 46. The engagement protrusion 46 is integrally formed with the upper shell 8*a* and has a tapered shape. Barbs 46*a* are formed on both sides of the engagement protrusion 46. The engagement protrusion 46 extends upward from a horizontal portion 47 that extends horizontally from an approximate center of a lower edge 12*a* of each of the side walls 12. The vertical position of the horizontal portion 47 is such that the horizontal portion 47 is surface mountable to a circuit board (not shown) when the connector 1 is mounted thereon. The horizontal portion 47 and the engagement protrusion 46 are collectively referred to as fixing portions 45.

A pair of downwardly extending legs or tines 48 are integrally formed at the lower edges 12*a* of each of the side walls 12. The tines 48 are received in apertures (not shown) of a circuit board (not shown) and soldered thereto when the connector 1 is mounted on the circuit board (not shown). Although the tines 48 are described as extending downward, the tines 48 may alternatively be formed to extend outward so as to enable surface mounting similar to the horizontal portions 47.

The lower shell 8*b* has a lower wall 20 that has upwardly extending side walls 18. Engagement pieces 52 protrude from both sides of a rear portion of the lower wall 20. The engagement pieces 52 are press-fit into holes (not shown) formed in the bottom 30 of the housing 2 and are engaged thereto when the shielding shell 8 and the housing 2 are assembled. A pair of latch arms or second locking members 16 is formed on each of the side walls 18 of the lower shell 8*b*. The latch arms 16 incline outwardly and correspond with the engagement apertures 10 to be fixed at upper ends thereof. The distance between the side walls 18 is shorter than the distance between the side walls 12 of the upper shell 8*a* so that the side walls 18 of the lower shell 8*b* are disposed inside the side walls 12 of the upper shell 8*a* when the upper shell 8*a* and lower shell 8*b* are assembled.

A bottom guide piece 54 is formed at a forward edge of the lower wall 20 and extends from one side wall 18 to the other side wall 18. Side guide pieces 56 are formed on each of the side walls 18. The bottom and side guide pieces 54, 56 guide the mating connector (not shown) into the engagement opening 24.

The side walls 18 have cutouts 58 corresponding to the openings 42 of the upper shell 8*a*. Steps 50 are formed between the lower wall 20 and the side walls 18. The steps 50 surround the housing 2 along the step 32 of the housing 2 when the shielding shell 8 and the housing 2 are assembled.

The assembly of the shielding shell 8 to the housing 2 will now be described in greater detail. The engagement pieces 57 of the upper shell 8*a* are press-fit into the holes 36 of the housing 2 to fix the upper shell to the housing 2. The engagement pieces 52 of the lower shell 8*b* are press-fit into the holes (not shown) on the bottom 30 of the housing 2 to fix the lower shell 8*b* to the housing 2. The side walls 18 of the lower shell 8*b* are disposed inside the side walls 12 of the upper shell 8*a* so that the side walls 12 and the side walls 18 overlap. The latch arms 16 engage with the engagement apertures 10 to fix the upper shell 8*a* and the lower shell 8*b* to each other.

When the latch arms 16 provided on the lower shell 8*b* engage with engagement apertures 10 provided on the upper shell 8*a*, the upper and lower shells 8*a*, 8*b* are fixed so that they do not move in vertical or horizontal directions with respect to each other. When the upper shell 8*a* and the lower shell 8*b* are fixed in the vertical direction, deformation in the vertical direction is prevented when a prying force is applied in the vertical direction. When a prying force is applied in the horizontal direction, the side walls 12 of the upper shell 8*a* prevent the lower shell 8*b* form opening to prevent deformation. In addition, because the upper shell 8*a* is fixed to the circuit board (not shown), vertical as well as horizontal movement of the upper shell 8*a* becomes difficult, further preventing deformation.

I claim:

1. An electrical connector mounted on a circuit board, comprising:

an insulating housing having contacts;

a shielding shell disposed about the housing, the shielding shell including a first shell and a second shell;

the first shell having a first side wall, the first side wall having a first locking member;

a leg extending from the first side wall, the leg being soldered to the circuit board; and the second shell having a second side wall, the second side wall having a second locking member corresponding to the first locking member, the second locking member engages the first locking member so that the first side wall overlaps with the second side wall and the first side wall is disposed on an outer surface of the second side wall when the first and second locking members are engaged to prevent movement of the second shell in a vertical and horizontal direction in relation to the first shell.

2. The electrical connector of claim 1, wherein the first locking member is an engagement aperture and the second locking member is a latch arm.

3. The electrical connector of claim 1, wherein the first shell is disposed on a top surface of the housing and the second shell is disposed on a bottom surface of the housing.

4. The electrical connector of claim 1, wherein the leg extends from a bottom surface of the first side wall and is substantially perpendicular to the circuit board.

5. The electrical connector of claim 4, wherein the leg is integrally formed with the first side wall.

6. The electrical connector of claim 1, further comprising grounding tongues extending from the shielding shell that contact a shielding shell of a mating connector.

7. The electrical connector of claim 1, wherein the shielding shell includes an opening for receiving a locking arm of a mating connector to attach the mating connector to the electrical connector.

8. The electrical connector of claim 1, wherein the first and second shells include engagement pieces that are press-fit into holes in the housing to fix the first and second shells to the housing.

9. The electrical connector of claim 1, further comprising fixing portions extending from the shielding shell that are surface mounted to the circuit board.

10. A shielding shell for an electrical connector comprising:

a first shell having a first shell end, the first shell end having a first locking member;

a leg extending from the first side wall for soldering to the circuit board; and a second shell having a second shell end, the second shell end having a second locking member corresponding to the first locking member, the second locking member engages the first locking member so that the first shell end overlaps with the second shell end and the first shell end is disposed on an outer surface of the second shell end when the first and second locking members are engaged to prevent movement of the second shell end in a vertical or horizontal direction in relation to the first shell end.

11. The shielding shell of claim 10, wherein the first locking member is an engagement aperture and the second locking member is a latch arm.

12. The shielding shell of claim 10, wherein the leg extends from a bottom surface of the first shell end and extends substantially perpendicular to the circuit board.

13. The shielding shell of claim 12, wherein the leg is integrally formed with the first shell end.

14. The shielding shell of claim 10, further comprising fixing portions extending from the first shell for surface mounting to the circuit board.

* * * * *

UNITED STATES PATENT AND TRADEMARK OFFICE

CERTIFICATE OF CORRECTION

PATENT NO. : 6,764,339 B2
DATED : July 20, 2004
INVENTOR(S) : Takafumi Kubo

It is certified that error appears in the above-identified patent and that said Letters Patent is hereby corrected as shown below:

Title page,
Item [57] ABSTRACT,
Line 1, “having” should read -- has --.
Line 2, “disposed” should read -- is disposed --.
Line 3, “including” should read -- includes --.
Lines 4 and 5, “having” should read -- has --.
Line 6, the first occurrence of “having” should read -- has --.
Line 6, the second occurrence of “having” should read -- has --.

Column 4,
Line 40, “the first side wall” should read -- the first shell end --.

Signed and Sealed this

Seventh Day of December, 2004

JON W. DUDAS
*Director of the United States Patent and Trademark Office*